US005587104A

United States Patent [19]

Zeise et al.

[11] Patent Number: 5,587,104

[45] Date of Patent: Dec. 24, 1996

[54] READILY SOLUBLE DRY CONCENTRATES CONTAINING INGREDIENTS OF DETERGENTS

[75] Inventors: Christiane Zeise, Korschenbroich; Wilfried Raehse, Duesseldorf; Jochen Jacobs, Wuppertal; Juergen Hoffmeister, Duesseldorf, all of Germany

[73] Assignee: Henkel Kommanditgesellschaft auf Aktien, Duesseldorf, Germany

[21] Appl. No.: 87,684

[22] PCT Filed: Dec. 10, 1991

[86] PCT No.: PCT/EP91/02366

§ 371 Date: Sep. 8, 1993

§ 102(e) Date: Sep. 8, 1993

[87] PCT Pub. No.: WO92/12229

PCT Pub. Date: Jul. 23, 1992

[30] Foreign Application Priority Data

Jan. 8, 1991 [DE] Germany ..... 41 00 306.3

[51] Int. Cl.[6] ..... C11D 17/00

[52] U.S. Cl. ..... 510/298

[58] Field of Search ..... 252/174

[56] References Cited

U.S. PATENT DOCUMENTS

| | | | |
|---|---|---|---|
| 4,144,226 | 3/1979 | Crutchfield et al. | 528/231 |
| 4,146,495 | 3/1979 | Crutchfield et al. | 252/89 R |
| 5,358,655 | 10/1994 | Kruse et al. | 252/174 X |
| 5,360,567 | 11/1994 | Fry et al. | 252/174 X |
| 5,362,413 | 11/1994 | Kaufmann et al. | 252/174 |

FOREIGN PATENT DOCUMENTS

| | | |
|---|---|---|
| 0219328 | 4/1987 | European Pat. Off. . |
| 0220024 | 4/1987 | European Pat. Off. . |
| 0229671 | 7/1987 | European Pat. Off. . |
| 0270240 | 6/1988 | European Pat. Off. . |
| 0273334 | 7/1988 | European Pat. Off. . |
| 0340013 | 11/1989 | European Pat. Off. . |
| 0367339 | 5/1990 | European Pat. Off. . |
| 2162353 | 7/1972 | Germany . |
| 2617697 | 11/1976 | Germany . |
| 3816842 | 11/1989 | Germany . |
| 3926253 | 2/1991 | Germany . |
| 4024759 | 2/1992 | Germany . |
| 1517713 | 7/1978 | United Kingdom . |
| 9102047 | 2/1991 | WIPO . |

*Primary Examiner*—Paul F. Shaver
*Attorney, Agent, or Firm*—Ernest G. Szoke; Wayne C. Jaeschke; Real J. Grandmaison

[57] ABSTRACT

Free-flowing and storable granular compacts containing ingredients of detergent or cleaning compositions in concentrated form are prepared by (1) preparing an adhesively bound dry premix containing (a) fine-particle detergent ingredients substantially free of binding or adhesive properties, and (b) fine-particle detergent ingredients having binding or adhesive properties, and optionally, detergent ingredients which are liquid at room temperature, to form a substantially homogeneous premix, and (2) press-molding the premix at a temperature of from about 40° C. to 80° C. in the substantial absence of shear forces whereby air is microdispersed in the resultant compacts.

21 Claims, No Drawings

READILY SOLUBLE DRY CONCENTRATES CONTAINING INGREDIENTS OF DETERGENTS

BACKGROUND OF THE INVENTION

1. Field of the Invention

This invention relates to a new formulation for ingredients of detergents and/or cleaning products, particularly laundry detergents, to correspondingly formulated detergents and/or cleaning products and to the new process for their production. More particularly, the invention relates to the production of a comparatively coarse-particle and permanently free-flowing material which, on the one hand, is compacted to high apparent densities but which, on the other hand, is capable by virtue of its special structure of rapidly interacting with liquid phases, particularly aqueous liquid phases, so that the particle structure is destroyed.

2. Discussion of Related Art

In recent years, there have been many proposals relating to the production of solid, powder-form or agglomerated granular detergents and/or cleaning products having high apparent densities. From the more recent past, reference is made to EP 340 013 and to the documents cited therein EP 219 328, EP 270 240 and GB 1,517,713 (all Unilever), EP 229 671 and JP 61 069 897 (Kao) and also to EP 220 024 (Procter & Gamble). The first of these documents describes granular detergent mixtures having an apparent density of at least 650 g/l which are obtained by mixing selected non-soap-like surfactants (at least partly corresponding anionic surfactants) in certain ratios with predeterminated quantities of crystalline or amorphous sodium aluminium silicate. The granules are said to be produced in a high-speed mixer/granulator which carries out the mixing and size reduction steps of the process. The process is carried out in the presence of a liquid binder, the preferred binder being water which, if necessary, may be added before or during the granulation step. According to the Examples, the particle size of the agglomerates obtained in this way is well below 1 mm and, in general, is in the range from about 400 to at most 600 μm.

A more recent proposal from the same applicants can be found in EP 367 339. This document also describes the production of comparatively fine detergent granules having apparent densities of at least 650 g/l. The production process is now said to be carried out in two stages: the fine-particle mixture of active substances is treated in a high-speed mixer and, at the same time, compacted in a first process step (5 to 30 seconds) and, in a following second process step, the compacted material is granulated at lower throughputs over a period of about 1 to 10 minutes, again with simultaneous compaction of the material. The material thus obtained is said to be dried and/or converted by cooling into the free-flowing state. The Examples of this document are concerned with comparing the respective apparent densities and the associated percentage particle porosities and particle sizes. It is shown that the described two-stage process provides for a distinct increase in apparent density—for example to values of up to about 950 g/l—accompanied by a substantial reduction in percentage particle porosity. Whereas the powders obtained by spray drying have apparent densities of around 400 g/l for a particle porosity of 45 to 50%, the apparent densities of the material compacted in two stages are in the range from about 700 to 900 g/l while particle porosity can be reduced to values below 20% and, in particular, below 10%. The particle size of the compacted material can reach a value of approximately 1 mm, but once again is generally well below that value.

In German patent application DE 39 26 253, the applicants responsible for the development disclosed in the following describe a new process for the production of solid free-flowing granules of detergents and/or cleaning products, more particularly corresponding laundry detergents. These granules are distinguished by apparent densities of at least about 700 g/l and preferably in the range from about 850 to 1,000 g/l. The granules are produced by extrusion using only very small quantities of liquid phase, particularly water, and in a preferred embodiment are additionally dried by removal of water in a following step. This process gives dry granules combining high density and high strength with high stability in storage under ambient conditions. The process described in this earlier application is characterized by intensive compounding of the mixture in screw extruders using high shear forces and processing pressures and, at the same time, by plasticization of the mixture. The compound homogenized in this form is extruded in the form of strands through perforated plates, the compacted strands issuing from the extruder are then cut to the predetermined size of the granules and, if desired, rounded before the individual granules are, if necessary, treated with other active substances and/or dried to form the granular free-flowing material.

The problem addressed by the present invention was to enable selected modifications to be made to the particular composition of the compacted, comparatively coarse granules without changing their granular appearance. More particularly, the problem addressed by the present invention was to enable the internal structure and, in particular, the microporosity of the granules to be controlled. The teaching of the invention was intended to enable the inner surface of the granules to be influenced, preferably in such a way that a large inner surface could be established in the granules despite high compaction of the mixture. In this connection, the particular object to be achieved by the invention was to ensure that the granular concentrates would dissolve rapidly and thoroughly in the wash liquor despite their high apparent densities. It is clear that the redissolvability of the granules can be influenced by increasing the inner surface of the granules, particularly through the inclusion and protection of very fine, microdisperse entrapped air.

Another important determining element of the process for producing concentrates with the new structure pursues the same objective, namely: the compaction and pressing of the material should be possible with hardly any need for the particular mixture to be exposed to shear forces. In particular, the smearing of the individual solid particles against one another which occurs, for example, when the corresponding solid mixtures are processed in screw extruders on account of their highly pronounced shear effect should be prevented as far as possible. This aspect is of particular significance in the case of auxiliaries and ingredients of detergents and/or cleaning products insofar as very greasy components, such as surfactants, polymeric builders and other mixture components deformable or even spreadable under pressure, are generally used in their case.

Another problem addressed by the invention was to enable permanently free-flowing concentrates combining high breaking strength with a minimal tendency of the individual particles to stick to one another during storage to be produced. In one important embodiment, the invention sought to enable compacts of the described type to be obtained as direct products of the process without any need for an intermediate drying step.

To solve these various problems, the invention provides a series of constructive elements concerning the composition of the granules or compacts on the one hand and the process parameters involved in the production of the compacted concentrates from the at least predominantly powder-form starting materials.

DESCRIPTION OF THE INVENTION

In a first embodiment, therefore, the present invention relates to dry concentrates containing ingredients of detergents and/or cleaning products in the form of free-flowing and storable coarse-particle compacts produced by the press-molding of an at least substantially homogenized fine-particle premix of the ingredients to which components liquid at room temperature may also be added in small quantities. According to the invention, the compacts are characterized in that they contain adhesively bound dry mixtures of (a) fine-particle ingredients without pronounced binding or adhesive properties (components (a)) with (b) fine-particle ingredients with adhesive or binding properties (adhesive components (b)).

The compacts are produced by press-molding at moderately elevated temperatures in the substantial absence of shear forces on the mixture to be compressed and contain (c) air in microdispersion in the compact.

In preferred embodiments, the average inner surface of the compacts (as determined by Hg porosimetry) is at least about 1 $m^2/g$, distinctly higher values, for example above 1.5 $m^2/g$ and, more particularly, around 2 $m^2/g$ or higher being preferred. In important cases, the compacts may have an inner surface in the range from about 3 to 5 $m^2/g$. It is well known that the inner surface of a microporous solid increases with increasing numbers of micropores. Accordingly, compacts of the described type in which the percentage content of micropores smaller than 1 μm in diameter makes up at least about 20 to 25% by volume and, more particularly, at least about 30% by volume, based on the total porosity, may be preferred for the purposes of the invention. Particularly preferred compacts are characterized by corresponding contents of micropores smaller than 1 μm in diameter of at least about 50% by volume. In general, the compacts according to the invention are characterized by microporosity scattered broadly over the range of individual pore diameters of about 0.001 to 10 μm.

In another embodiment, the invention relates to a process for the production of the granular compacts, characterized in that the components (a) and the adhesive components (b) in the form of fine particles are mixed at least substantially homogeneously to form a loose bulk material under conditions under which no decidedly solidifying adhesive function is performed. Any liquid components used—which should only be present in very small quantities, as will be explained in detail hereinafter—are mixed in at the same time. The loose material thus prepared is then press-molded in the substantial absence of shear forces (at least on the main part of the material) with inclusion of microdisperse air to form compacts. These processing conditions are established in the preferred embodiment of the invention by press-molding in a cavity press, the bulk material being applied to a surface of a rotating cavity formed with bores, rolled into the bores with compaction by means of a pressing tool rotating just above the surface of the cavity and pressed through the bores to form the granules.

An annular cavity press consisting essentially of a rotating hollow roller into which radial bores are introduced is particularly suitable for carrying out the process according to the invention. A pressure roller is eccentrically arranged and rotatably mounted in the annular cavity. The mixture is introduced into the interior of the annular cavity, drawn into the gap between the pressure roller and the annular cavity and extruded. In the preferred embodiment of the process according to the invention, the temperature of the mixture in the annular cavity press can be selectively controlled or established, more particularly by temperature regulation via the coolable and/or heatable pressing tool. By controlling temperature in this way, by variation of the height of the roller gap between the pressing tool and the surface of the cavity and by applying the operating parameters of the annular cavity press described in detail hereinafter, it is possible to control both the desired degree of compaction and the internal porosity of the granules.

The dry concentrates according to the invention are produced in two successive steps:

In the first step, solid fine-particle ingredients of detergents and cleaning products, which preferably contain no particles larger than 100 μm in diameter, are substantially present in dry form and can be assigned to two different classes of substances, are mixed homogeneously with one another. The first class of substances are ingredients with no pronounced adhesive properties which are referred to herein as "components (a)". By contrast, the second class of substances are fine-particle ingredients with adhesive properties which are referred to in the description of the invention as "adhesive components (b)".

Concentrated detergents and/or cleaning products in dry form generally contain a large number of representatives of both classes of substances. Fine powders of this type solid at room temperature are either available as commercial products or may be produced by methods known per se, for example by spray drying.

Adhesive components (b) in the context of the invention are, in particular, representatives of detergent ingredients which are present in solid form at room temperature, but which soften at least superficially through an increase in temperature and/or through the addition of very limited quantities of liquid additives and/or develop a certain tackiness and adhesiveness with respect to the adjacent solid particles by application of pressure and temperature and subsequent cooling. Typical examples of compounds of this type are fine-particle surfactant compounds solid at room temperature which are typically used in detergents and cleaning products. The particular type of surfactant used is largely irrelevant for solving the problem addressed by the invention providing the surfactant compound selected can perform its function as the adhesive component (b). Accordingly, both the numerous anionic surfactant compounds solid at room temperature which are used in practice and corresponding ampholytic or zwitterionic surfactants are suitable. Nonionic surfactant compounds may also be assigned to class (b) providing they form a solid phase at room temperature. However, the fact that liquid auxiliary components, particularly nonionic surfactants liquid at room temperature, can also perform an important auxiliary function in strengthening the adhesive components (b) in the production of the compacts according to the invention is discussed in detail hereinafter.

Another important class of substances from detergents, particularly laundry detergents, which belong to the adhesive components (b) are selected builders, optionally using limited quantities of moisture. Typical representatives of such adhesive components are polymer compounds of synthetic and/or natural origin such as, for example, the polymers or copolymers of acrylic acid which are now normally used as so-called co-builders for inactivating water hardness in the washing process. It is clear that other organic components, particularly organic polymer compounds capable of performing a corresponding adhesive function may also be used. Starch and starch derivatives, cellulose and cellulose derivatives and the like are mentioned as examples of such adhesive components which may be used, for example, to improve the soil suspending power of the wash liquor.

Limited quantities of components liquid at room temperature may be used to support activation of the adhesive components in the pressing step. The most important representatives (which may be used either on their own or even in admixture with one another) are the nonionic surfactants liquid at room temperature already mentioned, water and/or selected oil phases. Nonionic surfactants liquid at room temperature are typical constituents of modern detergents and cleaning products and, accordingly, are also important mixture components in the context of the teaching according to the present invention. They perform an important additional function as activating agents for the adhesive components (b).

If necessary, water may be added in small quantities in the preparation of the mixture to be press-molded. It may be used in particular together with representatives of the above-mentioned classes (a) and/or (b) of substances. For example, aqueous pastes of anionic surfactants and/or non-adhesive active substances (a), such as fine-particle sodium zeolite, may be used in the preparation of the mixture to be press-molded.

Possible oil phases for use in the mixtures according to the invention are, for example, limited quantities of paraffin oils, ester oils and also monohydric and/or polyhydric alcohols of low volatility, corresponding ethers and the like.

Fine-particle ingredients of detergents and/or cleaning products without pronounced adhesive or binding properties, i.e. components (a), are regular constituents of the mixtures according to the invention. In general, these fine-particle ingredients are water-soluble or moderately water-soluble to water-insoluble components of inorganic origin or even organic mixture components having a comparatively high softening or melting point. The representatives may be assigned to various classes of substances, for example to builders, for example of the zeolite NaA type, bleaches, bleach activators, fabric softeners, such as swellable fine-particle layer silicates, and inorganic alkaline or neutral to mildly acidic salts, for example sodium silicate, sodium carbonate, sodium hydrogen carbonate, sodium sulfate, sodium hydrogen sulfate and perborate. General expert knowledge allows the particular components to be assigned either to the group of components (a) or to the adhesive components (b) according to the invention in the particular formulation required.

The granulation or compacting process according to the invention is carried out in two stages. In the first stage, the fine-particle components belonging to classes (a) and (b), which are predominantly solid at room temperature, are mixed thoroughly with one another. Mixing may be carried out in any of the low-speed to high-speed mixers typically used in practice, such as for example ploughshare mixers, segmented screw mixers, paddle mixers, pinned disk mixers, Eirich mixers, centrifugal mixers, horizontal high-speed mixers, multi-channel fluid mixers and the like.

By virtue of the composition of the premix and the working conditions prevailing in this initial stage, the individual particles are not exposed during the treatment to strong shear forces which could lead to significant smearing of basically greasy constituents of the mixture. Any liquid constituents used in this initial stage are homogeneously incorporated in the mixture. This is possible, for example, by spraying on corresponding liquid constituents before or during this premixing stage or by introducing water-based pastes of active substances into this premixing stage.

By suitably selecting and coordinating the mixture components with one another, it is possible in the following second stage of the process according to the invention to build up the required microporous particle structure which combines high apparent densities with a comparatively large inner surface of the granules. Taking the following observations on the second stage of the process into consideration, the particular mixing ratios between the components may be optimized on the basis of general expert knowledge. The following rules may serve as reference points in this regard:

The solid dry powder components (a) and (b) together make up at least about 90% by weight and preferably at least about 94% by weight of the mixture to be prepared in the first stage of the process. Accordingly, liquid components are preferably present in quantities of at most about 10% by weight, preferably in quantities of from about 1 to 8% by weight and, more preferably, in quantities of about 2 to 6% by weight. If water is used as a mixture component either directly or indirectly via an aqueous paste, it is advisable, even despite the small quantities mentioned here, to use mixture components having a high water binding capacity on the solid powder side. In this way, the desired structure of the granules can be obtained, even without an additional drying step, by internal drying, for example through the complete or partial binding of the water as water of crystallization.

The premix is generally present in the form of a dry powder at the beginning of the second stage of the process. A particularly advantageous embodiment of the invention uses the following control element for correctly coordinating the active substance components in the mixture to be press-molded: the fine-particle solids with and without adhesive or binding properties and the liquid constituents used, if any, are used in such mixing ratios to one another that, in addition to the desired compacts, traces or small quantities of unsolidified powder are extruded as the primary product of the extrusion step under the press-molding conditions prevailing in the second stage of the process. Accordingly, in the second stage of the process, the mixtures are coordinated with one another in regard to their tackiness in such a way that, under the working conditions applied, the material is at the limit of extrudability to adhesive strands or granules to be obtained therefrom. This limit may easily be exceeded on either side. In one preferred embodiment, the limit is extended to inadequate adhesion, i.e. to the co-extrusion of small powder-form residues. The components co-extruded in powder form may make up, for example, as much as 10% by weight and preferably up to about 5% by weight, based on the extrudate as a whole. In the processing of this extrudate to granules, which will be described hereinafter, the powder-form residue acts as an auxiliary for powdering the primary extrudates of which the tackiness is attributable in particular to their slightly elevated processing temperature.

The homogenized premix from the first stage of the process is compacted into strands in the second stage, these strands best being chopped into granules immediately after leaving the annular cavity.

An important requirement for the compaction and, at the same time, maintenance of the microporous structure in the second stage of the process is the compression of the premix in the substantial absence of shear forces acting on the main part of the mixture. Microdisperse air is included in this way, leading to the desired microporosity.

It has proved to be of advantage to use a annular cavity press of the type described, for example, in DE 38 16 842 for putting this concept into practice. This document describes an annular cavity press with a rotating annular cavity permeated by bores and at least one pressure roller communicating with its inner surface which presses the material fed to the cavity through the bores to form a strand of material. The interacting surfaces of the annular cavity and the pressure roller(s) are designed to be driven in the same direction. In the preferred embodiment of the process according to the invention, the peripheral speeds of the annular cavity and the pressure roller can be coordinated with and adapted to one another in such a way that no shear forces or hardly any shear forces are applied to the mixture introduced into the interior of the annular cavity. In this way, the objective of the invention is promoted in several ways. The mixture containing microdisperse air is pressurized and hence compacted solely by the extrusion pressure without destroying the initially predetermined structure of high microporosity. The desired outcome are the comparatively high values of the inner surface of the compacts which may range, for example, from 2 to 5 $m^2/g$ and, more particularly, from about 3 to 5 $m^2/g$. Values of this order can only be established if the percentage of micropores below 1 μm, preferably below 0.1 μm or even below 0.01 μm in diameter is kept comparatively high.

However, the processing of the mixture homogenized in the substantial absence of shear forces in the first stage of the process also affords other advantages. The constituents of the mixture are present individually alongside one another as in a packing so that there is no smearing of plastic and/or thermoplastic components over relatively large regions of adjacent surfaces of solid particles. This can be of substantial assistance to the rapid redissolvability of the compacts. Readily water-soluble mixture components, for example corresponding neutral salts and/or washing alkalis, are accessible on exposure to water to direct interaction with the water, in order words there is no need for the preliminary removal of, for example, a surfactant layer smeared over the finely crystalline material.

Finally, the fact that no shear forces are applied to the loose material during its compaction also has a favorable effect in limiting the increase in temperature which always accompanies the introduction of the considerable mechanical forces into the loose material to be compacted. According to the invention, it is preferred in the interests of further improved temperature control to use annular cavity presses which incorporate a temperature control system inside the annular cavity. A suitable embodiment is described in DE 38 16 842 which has already been mentioned. In this case, the temperature of the pressure roller can be controlled by a heating and cooling medium. The process according to the invention makes use of this in the second stage. In one preferred embodiment, the material temperatures do not exceed values of about 80° C. and, preferably, values of about 70° C. in the annular cavity. Lower limits to the temperature of the material in the processing step are typically in the range from about 30° to 40° C., temperatures in the range from about 45° to 60° C. being particularly suitable working temperatures for the pressing of the loose material.

The above-described temperature conditions may in turn be instrumental in determining the choice of the adhesive components (b) and/or the use of liquid components in the first mixing stage. Thus, it can be of advantage to use adhesive components (b) in the form of fine particles which are distributed substantially uniformly throughout the mixture and which soften at temperatures above 40° C. and, more particularly, at temperatures in the range from about 45° to 70° C.—optionally in conjunction with the mixture constituents liquid at room temperature—to such an extent that they develop an adhesive effect under the working conditions according to the invention and subsequently in the re-cooled granular extrudate.

The possibility of controlling the temperature in the second processing step is also intrumental inter alia in determining the mixing ratios between the dry components (a) and the adhesive components (b) in the multicomponent mixtures used. In general, the adhesive component(s) (b) are generally used in at most substantially the same quantities as the components (a), although smaller quantities of (b) relative to (a) are normally preferred. Suitable mixtures according to the invention contain the adhesive components (b) in quantities of from about 15 to 40% by weight, based on the compacts.

Without affecting the microporous basic structure —with its large inner surface—targeted by the invention, the extrudates extruded as strands and preferably chopped into granules immediately afterwards can be adjusted to apparent densities of at least 500 g/l. The apparent densities of the granular compacts according to the invention are of the order of 600 g/l or higher, distinctly higher values, for example up to about 900 g/l or even higher, being obtainable according to the working conditions and the choice and adaptation of the mixture components to one another. Particularly suitable apparent densities may be, for example, in the range from about 550 to 850 g/l.

Suitable particle sizes for the compacts according to the invention are, for example, in the range from about 1 to 3 mm. The compacts may be either rodlet-like or spherical as known per se. To this end, it can be advisable to press the material in approximately 0.8 to 1.5 mm diameter bores and to cut the extrudate to lengths of, preferably, about 1 to 2 mm. If desired, the freshly extruded pressings may be spheronized in a subsequent step, the spheronizing step best being carried out before the material solidifies through the reduction in temperature.

Other auxiliary measures known per se for stabilizing the compacts initially formed, which may be applied in accordance with the invention, include for example the shock cooling of the strands initially issuing from the extruder and the granules obtained therefrom, for example by means of stripping blades, if desired drying of the granules, for example in a fluidized bed dryer, and/or powdering the primary granules with fine powder. As already mentioned, however, the need for such auxiliary measures may even be eliminated altogether by suitably selecting the type and/or quantity of mixture components used in accordance with the invention or, alternatively, a small powder component may be extruded with the strands and may be used for powdering the primary granules in the subsequent spheronizing step. The compacts thus produced may be further processed into the required formulation in another process step. For example, the compacts may be blended together with other detergent ingredients obtained by granulation, spray drying, pelleting or extrusion. However, the compacts are preferably packed separately. In a particularly preferred embodiment, the compacts—which represent either complete detergents or detergent additives—are packed in portions, one portion normally being sufficient for one wash program.

General observations are made in the following on the list of suitable active substances and on the composition of suitable mixtures of active substances, the components mentioned individually being assigned to the classes of dry components (a), adhesive components (b) and the liquid components optionally used in small quantities on the basis of general expert knowledge in the light of the observations on the process according to the invention and the working conditions applied. In this connection, reference may also be made to the extensive specialist literature, including the relevant patent literature and textbooks on detergents and cleaning products.

Suitable anionic surfactants are, for example, soaps of natural or synthetic, preferably saturated, fatty acids. Particularly suitable anionic surfactants are soap mixtures derived from natural fatty acids, for example coconut oil, palm kernel oil or tallow fatty acids. Mixtures of which 50 to 100% consist of saturated $C_{12-18}$ fatty acid soaps and 0 to 50% of oleic acid soap are preferred. Other suitable synthetic anionic surfactants are those of the sulfonate and sulfate type.

Suitable surfactants of the sulfonate type are alkylbenzene sulfonates, preferably $C_{9-13}$ alkylbenzene sulfonates, olefin sulfonates, i.e. mixtures of alkene and hydroxyalkane sulfonates, and also disulfonates which may be obtained, for example, from $C_{12-18}$ monoolefins containing a terminal or internal double bond by sulfonation with gaseous sulfur trioxide and subsequent alkaline or acidic hydrolysis of the sulfonation products. Also suitable are alkane sulfonates obtainable from $C_{12-18}$ alkanes by sulfochlorination or sulfoxidation and subsequent hydrolysis or neutralization or by bisulfite addition onto olefins and, in particular, the esters of α-sulfofatty acids (ester sulfonates), for example the α-sulfonated methyl esters of hydrogenated coconut oil, palm kernel oil or tallow fatty acids.

Suitable surfactants of the sulfate type are the sulfuric acid monoesters of primary alcohols of natural and synthetic origin, i.e. of fatty alcohols, for example coconut oil fatty alcohols, tallow fatty alcohols, oleyl alcohol, lauryl, myristyl, palmityl or stearyl alcohol, or the $C_{10-20}$ oxoalcohols and those of secondary alcohols having the same chain length. The sulfuric acid monoesters of alcohols ethoxylated with 1 to 6 mol ethylene oxide, such as 2-methyl-branched $C_{9-11}$ alcohols containing on average 3.5 mol ethylene oxide, are also suitable as are sulfated fatty acid monoglycerides.

The anionic surfactants may be present in the form of their sodium, potassium and ammonium salts and as soluble salts of organic bases, such as mono-, di- or triethanolamine. The content of anionic surfactants or anionic surfactant mixtures in the detergents according to the invention is preferably 5 to 40% by weight and, more preferably, 8 to 30% by weight.

Suitable nonionic surfactants are adducts of 1 to 40 mol and preferably 2 to 20 mol ethylene oxide with 1 mol of an aliphatic compound essentially containing 10 to 20 carbon atoms from the group of alcohols, carboxylic acids, fatty amines, carboxylic acid amides or alkane sulfonamides. The adducts of 3 to 20 mol ethylene oxide with primary alcohols, for example with coconut oil or tallow fatty alcohols, with oleyl alcohol, with oxoalcohols or with secondary alcohols containing 8 to 18 and preferably 12 to 18 carbon atoms are particularly important.

In addition to the water-soluble nonionics, however, water-insoluble or substantially water-insoluble polyglycol ethers containing 2 to 7 ethylene glycol ether units in the molecule are also of interest, particularly when used in conjunction with water-soluble nonionic or anionic surfactants.

Other suitable nonionic surfactants are alkyl glycosides corresponding to the general formula R—O—$(G)_x$ in which R is a primary linear or 2-methyl-branched aliphatic radical containing 8 to 22 and preferably 12 to 18 carbon atoms, G is a symbol which stands for a glycose unit containing 5 or 6 carbon atoms and the degree of oligomerization x is between 1 and 10 and preferably between 1 and 2, more preferably well below 1.5 and, for example, between 1.1 and 1.4.

Suitable organic and inorganic builders are soluble and/or insoluble components showing a mildly acidic, neutral or alkaline reaction which are capable of precipitating or complexing calcium ions. Suitable and, in particular, ecologically safe builders, such as finely crystalline synthetic water-containing zeolites of the NaA type, which have a calcium binding power of 100 to 200 mg CaO/g, are preferably used. Their particle size is normally in the range from 1 to 10 μm while their content in the detergents is generally from 0 to 60% by weight and preferably from 10 to 45% by weight, based on anhydrous substance.

Other co-builder components which, in particular, may be used together with the zeolites include (co)polymeric polycarboxylates, such as polyacrylates, polymethacrylates and, in particular, copolymers of acrylic acid with maleic acid, preferably those with 50% to 10% maleic acid. The molecular weight of the homopolymers is generally in the range from 1,000 to 10,000 while the molecular weight of the copolymers is in the range from 2,000 to 200,000 and preferably in the range from 50,000 to 120,000, based on free acid. A particularly preferred acrylic acid/maleic acid copolymer has a molecular weight of 50,000 to 100,000. Suitable, but less preferred compounds of this class are copolymers of acrylic acid or methacrylic acid with vinyl ethers, such as vinyl methyl ether, in which the acid makes up at least 50%. Other suitable builders are polyacetal carboxylic acids, for example of the type described in U.S. Pat. Nos. 4,144,226 and 4,146,495, and also polymeric acids which are obtained by polymerization of acrolein and subsequent disproportionation with alkalis and which are made up of acrylic acid units and vinyl alcohol units or acrolein units.

Suitable organic builders are, for example, polycarboxylic acids which are preferably used in the form of their sodium salts, such as citric acid and nitrilotriacetate (NTA), providing there are no ecological objections to their use.

In cases where a phosphate content can be tolerated, it is also possible to use phosphates, more particularly pentasodium triphosphate, and even pyrophosphates and orthophosphates which act primarily as precipitants for lime salts. The phosphate content, based on pentasodium triphosphate, is below 30% by weight. However, phosphate-free detergents are preferred.

Suitable inorganic non-complexing salts are the bicarbonates, carbonates, borates or silicates of the alkali metals which are also known as "washing alkalis". Of the alkali metal silicates, sodium silicates with an $Na_2O$ to $SiO_2$ ratio of 1:1 to 1:3.5 are particularly suitable.

Further ingredients of the detergents are redeposition inhibitors (soil suspending agents), foam inhibitors, bleaches and bleach activators, optical brighteners, enzymes, fabric softeners, dyes, perfumes and neutral salts.

Redeposition inhibitors keep the soil detached from the fibres suspended in the wash liquor and thus prevent redeposition. Suitable soil suspending agents are generally organic water-soluble colloids, such as for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. It is also possible to use soluble starch preparations and other starch products than those mentioned above, such as for example degraded starch, aldehyde starches, etc. Polyvinylpyrrolidone may also be used. Carboxymethyl cellulose (Na salt), methyl cellulose, methyl hydroxyethyl cellulose and mixtures thereof and also polyvinyl pyrrolidone are preferably used, more particularly in quantities of 0.1 to 5% by weight, based on the detergent.

The foaming power of the surfactants may be increased or reduced by combinations of suitable surfactants; a reduction may also be obtained by additions of non-surface-active organic substances. In many cases, reduced foaming power, which is desirable where the detergents are used in washing machines, is achieved by combinations of various surfactants, for example sulfates and/or sulfonates with nonionics and/or with soaps. With soaps, foam suppression increases with the degree of saturation and the C chain length of the fatty acid component. Accordingly, suitable foam inhibitors are soaps of natural and synthetic origin which have a high percentage content of $C_{18-24}$ fatty acids. Suitable non-surface-active foam inhibitors are organopolysiloxanes and mixtures thereof with microfine, optionally silanized silica, paraffins, waxes, microcrystalline waxes and mixtures thereof with silanized silica. Bisacylamides derived from $C_{12-20}$ alkyl amines and $C_{2-6}$ dicarboxylic acids may also be used. Mixture of various foam inhibitors, for example mixtures of silicones and paraffins or waxes, may also be used with advantage. The foam inhibitors are preferably fixed to a granular carrier soluble or dispersible in water.

Among the compounds yielding $H_2O_2$ in water which are used as bleaches, sodium perborate tetrahydrate and sodium perborate monohydrate are particularly important. Other useful bleaches are, for example, peroxycarbonate, peroxypyrophosphates, citrate perhydrates and $H_2O_2$-yielding peracid salts or peracids, such as perbenzoates, peroxophthalates, diperazelaic or diperdodecanedioic acid.

To obtain an improved bleaching effect where washing is carried out at temperatures of 60° C. and lower, bleach activators may be incorporated in the detergents. Examples of suitable bleach activators are N-acyl or O-acyl compounds which form organic peracids with $H_2O_2$, preferably N,N'-tetraacylated diamines, such as N,N,N'N,'-tetraacetyl ethylene diamine, also carboxylic anhydrides and esters of polyols, such as glucose pentaacetate.

The detergents may contain derivatives of diaminostilbene disulfonic acid and alkali metal salts thereof as optical brighteners. Suitable optical brighteners are, for example, salts of 4,4'-bis-(2-anilino-4-morpholino-1,3,5-triazin-6-ylamino)-stilbene-2,2'-disulfonic acid or compounds of similar structure in which the morpholino group is replaced by a diethanolamino group, a methylamino group, an anilino group or a 2-methoxyethylamino group. Brighteners of the substituted 4,4'-distyryl diphenyl type, for example the compound 4,4'-bis-(4-chloro-3-sulfostyryl)-diphenyl, may also be present. Mixtures of the brighteners mentioned above may also be used.

Suitable enzymes are those from the class of proteases, lipases and amylases or mixtures thereof. Enzymes obtained from bacterial strains or fungi, such as *Bacillus subtilis, Bacillus licheniformis* and *Streptomyces griseus,* are particularly suitable. Proteases of the subtilisin type and, in particular, proteases obtained from *Bacillus lentus* are preferably used. The enzymes may be adsorbed onto carriers and/or encapsulated in shell-forming substances to protect them against premature decomposition.

Suitable stabilizers, particularly for per compounds and enzymes, are the salts of polyphosphonic acids, more particularly the sodium salts of 1-hydroxyethane-1,1-diphosphonic acid (HEDP) or diethylene triamine pentamethylene phosphonic acid (DTPMP or DETPMP).

The teaching according to the invention is suitable both for the production of detergent mixtures, particularly laundry detergents, in the form of readily water-soluble storable granules, and for the production of active-substance concentrates from the field of detergents, particularly for incorportion in laundry detergents containing granules of various active substances in predetermined mixing ratios. The following case is mentioned purely by way of example in this regard: to establish high stability in storage of a laundry detergent suitable for washing at low temperatures in dry form, perborates and bleach activators have to be provided separately from one another in different granules which are then mixed in predetermined ratios. The two types of granules may be produced separately from one another in accordance with the invention and subsequently stored in stable form in admixture with one another. For example, the process according to the invention may be used with advantage for the production of bleach activator granules of the type described, for example, in earlier German patent application P 40 24 759.

EXAMPLES

To produce the granular, readily soluble dry concentrates, components (A) to (K), of which only components (B) were present in liquid form (all the other components being solid), were intensively mixed for 1 minute in a plowshare mixer (L ödige, Germany) in the ratios shown in the Table. The premix thus obtained was then fed continuously to an annular cavity press (a pellet press according to DE 38 16 842; manufacturer: Schlüter, Germany) of which the temperature-controlled edge runner (pressure roller) was cooled to 20° C. Since the product generally undergoes increases in temperature while the process is being carried out, the edge runner has to be cooled. A product temperature of at most 50° C. was established in this way. The diameter of the bores in the annular cavity was 1 to 1.5 mm (see Table 1). The interval between the pressure roller and the annular cavity was 1.8 to 2 mm (see Table 1). The issuing strand was cut to a length of 1.2 to 1.5 mm by a blade mounted on the outside of the annular cavity. In addition, the granules thus formed were spheronized in a commercial spheronizer of the Marumerizer® type. The surface of the particles was prevented from becoming tacky by powdering with the fine dust formed during the process so that there was no need for another solid to be separately added. Products 1 to 6 thus produced were sieved: fines (smaller than 0.6 mm) and oversize particles (larger than 1.6 mm) were separated off. In every case, the fine component of the granules was under 5% and the oversize component under 1%. The apparent density of the sieved products varied between 650 g/l and 770 g/l.

The concentrates produced in Examples 1 to 6 may be directly used as detergents or, if desired, may be mixed with non-pelleted or pelleted but separately produced formulation ingredients.

TABLE 1

| | Examples | (Composition in % by weight) 1 | 2 | 3 | 4* | 5* | 6 |
|---|---|---|---|---|---|---|---|
| (A) | Anionic surfactants | | | | | | |
| (A 1) | Sodium dodecyl benzene sulfonate (96%) | 35 | 28 | 28 | 22 | 16 | 16.5 |
| (A 2) | $C_{16-18}$ tallow alcohol sulfate | — | 10 | — | — | 6 | 5 |
| (B) | Nonionic surfactants | | | | | | |
| (B 1) | 80% $C_{12-18}$ fatty alcohol .5 EO and 20% $C_{12-14}$ fatty alcohol.3 EO | — | — | — | 2.2 | 2.2 | — |
| (B 2) | $C_{12-18}$ fatty alcohol. 5 EO | 1 | — | — | 1.8 | 1.8 | 3.5 |
| (B 3) | $C_{12-18}$ fatty alcohol. 20 EO | — | 1 | 1 | — | — | — |
| (B 4) | 50% oleyl/cetyl alcohol .5 EO and 50% oleyl/ cetyl alcohol.10 EO | 1 | 1 | 1 | — | — | 1 |
| (C) | Zeolite NaA | 40 | 30 | 30 | 33 | 33 | 40 |
| (D) | Perborate monohydrate | — | — | — | 14.2 | 14.2 | — |
| (E) | Maleic acid/acrylic acid copolymer | 2 | 3 | 3 | 5 | 5 | 6 |
| (F) | Foam inhibitor concentrate | — | — | — | 5 | 5 | — |
| (G) | Alkyl polyglucoside | — | — | 10 | — | — | — |
| (H) | Sodium silicate ($Na_2O:SiO_2$1:3.0) | — | — | — | 3 | 3 | — |
| (I) | $C_{12-18}$ sodium fatty acid soap | — | 1 | 1 | 0.8 | 0.8 | 1 |
| (K) | Inorg. salts | | | | | | |
| (K 1) | $NAHSO_4.H_2O$ | 2 | 2 | 2 | — | — | 2 |
| (K 2) | $Na_2CO_3$ | — | — | — | 13 | 13 | — |
| (K 3) | $Na_2SO_4$ | 19 | — | — | — | — | 25 |
| (K 4) | $NaHCO_3$ | — | 25 | 25 | — | — | — |
| | Cavity diameter (mm) | 1.2 | 1.2 | 1.2 | 1.5 | 1.2 | 1.2 |
| | Edge runner/cavity interval (mm) | 1.8 | 1.8 | 1.8 | 2.0 | 2.0 | 2.0 |
| | Apparent density (g/l) | 650 | 680 | 660 | 720 | 770 | 810 |

*These are formulations which, after pelleting, were mixed with 5.5% by weight TAED pellets, 1.5% by weight enzymes and 0.5% by weight perfume, based on the sum of pellet and additives.

Examples 7 to 15

The compacts of Example 4 and compacts according to the invention of a number of other formulations were measured by Hg porosimetry. The following parameters were determined:

inner total volume in $mm^3/g$ total porosity in % by volume mean pore radius in micrometers specific surface in $m^2/g$ relative volume distribution in $mm^3/g$ in the following pore radius ranges (in μm): 0.001 to 0.01; 0.01 to 0.1; 0.1 to 1; 1 to 10 and 10 to 100.

The compacts tested were produced in the same way as described in Examples 1 to 6 and correspond to the following formulations:

Example 4

As above

Example 7

Bleach activator granules of the following constituents:

80% by weight TAED 8.0% by weight sodium dodecylbenzene sulfonate (96%)

4.0% by weight $C_{16/18}$ tallow alcohol sulfate 6.0% by weight $C_{12-18}$ fatty alcohol • 5 EO 2.0% by weight zeolite NaA

Example 8

Bleach activator granules of the following composition:

85% by weight TAED

10% by weight sodium dodecylbenzene sulfonate (96%)

5.0% by weight $C_{12-18}$ fatty alcohol • 7 EO

The formulations for the granules or compacts of Examples 9 to 15 are shown in Table 2 below. The materials of Examples 11 to 15 are pellets produced in accordance with the invention by means of a pellet press. By contrast, the granules of Examples 9 and 10 are extrudates which have been produced by extrusion in a screw extruder followed by a perforated plate in accordance with the teaching of German patent application 39 26 253. These two examples have been included as Comparison Examples. In particular, the granules show a distinctly smaller specific inner surface (Table 3) than the pellets produced in the pellet press in accordance with the invention.

TABLE 2

| Examples | 9 | 10 | 11 | 12 | 13 | 14 | 15 |
|---|---|---|---|---|---|---|---|
| Zeolite NaA | 25.4 | 37.0 | 35 | 30 | 25 | 20 | 20 |
| Na dodecylbenzene sulfonate | 13.5 | 17.6 | 35 | 35 | 35 | 35 | 34 |
| Maleic/acrylic acid copolymer | 3.0 | 4.0 | 2 | 2 | 2 | 2 | 2 |
| $Na_2SO_4$ | 45.6 | 29.5 | 17 | 17 | 17 | 17 | 16 |
| $NaHSO_4.H_2O$ | 1.4 | — | 2 | 2 | 2 | 2 | 2 |
| $C_{16-18}$ fatty alcohol.20 EO | — | — | 1 | 1 | 1 | 1 | 1 |
| Cumene sulfonate | — | — | 1 | 1 | 1 | 1 | 1 |
| $NaHCO_3$ | — | — | 5 | 10 | 15 | 20 | 19 |
| 50% Oleyl/cetyl alcohol.5 EO<br>50% Oleyl cetyl alcohol.10 EO | 1.0 | 1.4 | 2 | 2 | 2 | 2 | 2 |
| 80% $C_{12-18}$ fatty alcohol.5 EO<br>20% $C_{12-18}$ fatty alcohol.3 EO | — | — | — | — | — | — | 3 |
| $C_{16-18}$ fatty alcohol.5 EO | 1.3 | 0.8 | — | — | — | — | — |
| $H_2O$ added | 8.3 | 8.8 | — | — | — | — | — |
| Fatty acid aminoamide (Talgamid B, a product of Henkel KGaA) | 0.5 | 0.9 | — | — | — | — | — |

The results obtained by Hg porosimetry are set out in Table 3 below.

TABLE 3

| Example | Inner total vol.mm³/g | Relative volume (mm³/g) in the range (μm): 0.001–0.1 | 0.01–0.1 | 0.1–1 | 1–10 | 10–100 |
|---|---|---|---|---|---|---|
| 4 | 29.80 | 10.44 | 8.14 | 4.07 | 7.16 | — |
| 7 | 57.76 | 6.01 | 5.72 | 25.61 | 20.42 | — |
| 8 | 30.54 | 8.85 | 6.42 | 7.31 | 7.97 | — |
| 9 | 53.79 | 2.01 | 3.37 | 45.99 | 2.41 | — |
| 10 | 58.05 | 0.57 | 6.63 | 50.85 | — | — |
| 11 | 96.06 | 8.56 | 11.44 | 56.23 | 19.83 | — |
| 12 | 83.59 | 8.76 | 11.78 | 38.73 | 24.32 | — |
| 13 | 75.63 | 9.22 | 13.51 | 24.62 | 28.28 | — |
| 14 | 80.36 | 9.23 | 13.94 | 21.26 | 35.94 | — |
| 15 | 83.84 | 8.88 | 13.83 | 42.00 | 19.13 | - |

| Example | Total porosity (% by volume) | Mean pore radius (μM) | Spec. surface (m²/g) |
|---|---|---|---|
| 4 | 4.5 | 0.005 | 4.71 |
| 7 | 7.27 | 1.189 | 2.83 |
| 8 | 3.78 | 0.005 | 3.91 |
| 9 | 9.46 | 0.596 | 1.13 |
| 10 | 9.28 | 0.211 | 1.01 |
| 11 | 13.64 | 0.422 | 4.65 |
| 12 | 12.03 | 0.422 | 4.43 |
| 13 | 11.04 | 3.35 | 4.51 |
| 14 | 11.65 | 4.73 | 4.57 |
| 15 | 12.07 | 0.422 | 4.54 |

Examples 16 to 28

The formulations of Examples 16 to 21 summarized in Table 4 below are special detergent compositions (special DT) compacted to granules having an average particle size of 1 to 1.2 mm.

The formulations of Examples 16 and 17 were again produced by extrusion in a screw extruder followed by a perforated plate in accordance with the teaching of German patent application DE 39 26 253 and, hence, are comparison products for the pelleted formulation mixtures according to Examples 18 to 21.

Table 5 below summarizes the formulations of Examples 22 to 28 which all relate to universal detergents (UDT). In this case, too, two representatives are processed by extrusion through a screw extruder followed by a perforated plate in the same way as described above (Examples 22 and 23). However, the same starting formulations are then processed once more to pellets in a pellet press in accordance with the invention, the formulation of Example 22 corresponding to Example 28 according to the invention and the formulation of Example 23 corresponding to Example 27 according to the invention.

The dissolving time of the granulated mixtures of Examples 16 to 28 in water (in seconds) is determined under identical standard conditions. The results obtained are set out in Table 6 below. Evaluation of the various groups of Examples shows the following:

Examples 16–21, special detergents

Whereas the mixtures pelleted in accordance with the invention all dissolve in less than 100 seconds, the dissolving time of the two extrudates is above 200 seconds.

Examples 22–28, universal detergents

Comparison of the extrudates (22 and 23) with the corresponding pellets (28 and 27) is interesting. Comparison of both associated pairs shows that the pellets dissolve more quickly than the extrudates. However, Examples 24 to 26 show that, depending on the formulation, granules produced in pellet form in accordance with the invention can also take a considerable time to dissolve.

TABLE 4

| Examples | Special detergents (special DT) 16 | 17 | 18 | 19 | 20 | 21 |
|---|---|---|---|---|---|---|
| Sodium dodecyl benzene sulfonate (96%) | 13.5 | 17.6 | 35.0 | 35.0 | 35.0 | 35.0 |
| Zeolite NaA | 25.4 | 37.0 | 35.0 | 30.0 | 25.0 | 20.0 |
| 50% Oleyl/cetyl alcohol.5 EO<br>50% Oleyl cetyl alcohol.10 EO | 1.0 | 1.4 | 1.0 | 1.0 | 1.0 | 1.0 |
| Talgamid B | 0.5 | 0.9 | — | — | — | — |
| Maleic acid/acrylic acid copolymer | 3.0 | 4.0 | 2.0 | 2.0 | 2.0 | 2.0 |
| $Na_2SO_4$ | 45.6 | 29.5 | 17.0 | 17.0 | 17.0 | 17.0 |
| $Na_2CO_3$ | — | — | — | — | — | — |
| $NaHSO_4.H_2O$ | 1.4 | — | 2.0 | 2.0 | 2.0 | 2.0 |
| Tallow alcohol + 20 EO | — | — | 1.0 | 1.0 | 1.0 | 1.0 |
| Cumene sulfonate | — | — | 2.0 | 2.0 | 2.0 | 2.0 |
| $NaHCO_3$ | — | — | 5.0 | 10.0 | 15.0 | 20.0 |
| Tallow alcohol + 5 EO | 1.3 | 0.8 | — | — | — | — |
| Added $H_2O$ | 8.3 | 8.8 | — | — | — | - |

Water present in starting materials was not separately taken into account.

TABLE 5

| Examples | Universal detergents (UDT) 22 | 23 | 24 | 25 | 26 | 27* | 28* |
|---|---|---|---|---|---|---|---|
| Sodium dodecylbenzene sulfonate (96%) | 22.4 | 11.1 | 13.6 | 13.7 | 13.6 | | |
| Zeolite NaA | 2.6 | 21.7 | 23.6 | 13.7 | 13.5 | | |
| Tallow alcohol.5 EO | 1.2 | 1.8 | 0.8 | 0.9 | 0.9 | | |
| Maleic acid/acrylic acid copolymer | 5.0 | 6.4 | 5.6 | 7.1 | 6.4 | | |
| $Na_2CO_3$ | 9.0 | 16.6 | 16.9 | 20.5 | 20.5 | | |
| 80% $C_{12-18}$ fatty alcohol.5 EO<br>20% $C_{12-14}$ fatty alcohol.3 EO | 2.3 | 4.3 | — | 6.0 | 6.1 | | |
| Sodium silicate ($Na_2O:SiO_2$1:3.0) | — | 1.8 | 5.4 | 2.1 | 2.1 | | |
| Sodium perborate monohydrate | 16.0 | 17.8 | 18.0 | — | — | | |
| Foam inhibitor concentrate | 5.2 | — | — | — | — | | |
| Zeolite-containing carrier beads (Wessalith ® CD, a product of Degussa, Federal Republic of Germany) | 31.3 | — | — | 22.2 | 22.5 | | |
| Minor components (dye, perfume, inorganic salts) | 1.5 | 1.4 | 0.9 | 1.8 | 2.3 | | |
| $H_2O$ | 2.3 | 16.3 | 13.4 | 12.0 | 11.7 | | |
| $C_{12-18}$ sodium fatty acid soap | 1.2 | 0.8 | 1.8 | — | 0.4 | | |

*Example 27: corresponds to Example 23
*Example 28: corresponds to Example 22

TABLE 6

| Example | conditions*) | Dissolving time (90% dissolution in water under standard (sec.) | Particle size (mm) |
|---|---|---|---|
| 16 | Spec. DT extrudate | 252 | 1.2 |
| 17 | Spec. DT extrudate | 230 | 1.2 |
| 18 | Spec. DT pellets | 80 | 0.4 1.25 |
| 19 | Spec. DT pellets | 91 | 0.4 1.25 |
| 20 | Spec. DT pellets | 80 | 0.4 1.25 |
| 21 | Spec. DT pellets | 99 | 0.4 1.25 |
| 22 | UDT extrudate | 324 | 1.6 |
| 23 | UDT extrudate | 282 | 1.4 |
| 24 | UDT pellets | 264 | 1.2 |
| 25 | UDT pellets | 216 | 1.0 |

TABLE 6-continued

| Example | conditions*) | Dissolving time (90% dissolution in water under standard (sec.) | Particle size (mm) |
|---|---|---|---|
| 26 | UDT pellets | 378 | 1.2 |
| 27 | UDT pellets (corresponding to UDT extrudate 23) | 198 | 1.0 |
| 28 | UDT pellets (corresponding to UDT extrudate 22) | 222 | 1.0 |

TABLE 6-continued

| Example conditions*) | Dissolving time (90% dissolution in water under standard (sec.) | Particle size (mm) |
|---|---|---|

*500 g demineralized water (20° C.) were introduced into a 1 liter glass vessel, the propeller stirrer was switched on to rotate at a speed of 900 r.p.m. and the conductivity measuring cell was introduced. 5 g of the detergent were then added. The change in conductivity was recorded by a recorder. The measurement was continued until there was no further increase in conductivity. The time elapsing before the conductivity becomes constant is the dissolving time of the detergent as a whole (100%). The dissolving time for 90% dissolution was calculated.

We claim:

1. Free-flowing and storable granular compacts comprising ingredients of detergent or cleaning compositions in concentrated form, said compacts having been prepared by the process of (1) preparing an adhesively bound dry premix containing
(a) fine-particle detergent ingredients substantially free of binding or adhesive properties, and
(b) fine-particle detergent ingredients having binding or adhesive properties to form a substantially homogeneous premix, and (2) press-molding said premix at a temperature of from about 40° C. to 80° C. in the substantial absence of shear forces whereby air is microdispersed in the resultant compacts.

2. Compacts prepared as in claim 1 having an apparent density of at least about 500 g./l.

3. Compacts prepared as in claim 1 having an inner surface, as determined by mercury porosimetry, of at least 1 $m^2/g$.

4. Compacts prepared as in claim 1 having a micropore content smaller than 1 μm in diameter of at least about 30% by volume.

5. Compacts prepared as in claim 1 wherein component (a) and component (b) are present in a weight ratio to each other so that the premix is at the limit of extrudability to adhesive strands and, in addition to forming said compacts, small quantities of unsolidified powder are extruded during the press-molding step as the primary product of the process.

6. Compacts prepared as in claim 1 containing washing-active constituents which are liquid at room temperature to establish firm adhesion in said compacts.

7. Compacts prepared as in claim 1 containing organic washing-active constituents as said component (b) whose adhesive properties are activated by the presence of constituents which are liquid at room temperature.

8. Compacts prepared as in claim 1 wherein said component (b) softens at a temperature above 40° C. or under the influence of mixture constituents which are liquid at room temperature.

9. Compacts prepared as in claim 1 wherein said component (b) is present in an amount at most substantially equal to said component (a).

10. Compacts prepared as in claim 1 wherein the amount of constituents which are liquid at room temperature is no more than about 10% by weight, based on the weight of said compacts.

11. Compacts prepared as in claim 1 wherein said component (a) is selected from the group consisting of wash-active builders, inorganic salts, bleaching agents, bleach activators, and layer silicates.

12. Compacts prepared as in claim 1 wherein said component (a) contains constituents capable of binding water of crystallization.

13. The process of producing free-flowing and storable granular compacts containing ingredients of detergent or cleaning compositions in concentrated form, comprising (1) preparing an adhesively bound dry premix containing
(a) fine-particle detergent ingredients substantially free of binding or adhesive properties, and
(b) fine-particle detergent ingredients having binding or adhesive properties to form a substantially homogeneous premix, and (2) press-molding said premix in the substantial absence of shear forces whereby air is microdispersed in the resultant compacts.

14. A process as in claim 13 wherein said press-molding step is carried out at a temperature of from about 40° C. to 80° C.

15. A process as in claim 13 wherein said press-molding step is carried out in a cavity press whereby said premix is applied to a surface of a rotating multiple-bore cavity, rolled into the bores, and simultaneously compacted by means of a pressing tool rotating on or slightly above the surface of said cavity and extruded in strand-form through the bores and cut into granules, the degree of compaction and the internal porosity of the granules being controllable particularly through the premix temperature and by variation of the height of the roller gap between said pressing tool and the surface of said cavity.

16. A process as in claim 15 wherein said cavity and said pressing tool are rotated in the same direction at substantially the same peripheral speeds.

17. A process as in claim 15 wherein said pressing tool is cooled to control the temperature of said premix to be pressed.

18. A process as in claim 15 wherein immediately after leaving the bores of said cavity, the strand-form compacts are chopped up by means of stripping blades.

19. A process as in claim 15 wherein said compacts are further processed and optionally dried or treated with a light scattering of powder.

20. A process as in claim 15 wherein said components (a) and components (b) are mixed in such ratios to each other that up to 10% by weight of loose powder is discharged from said press and accumulate together with said compacts during said pressing step.

21. A process as in claim 15 wherein said premix is pressed in bores of about 0.8 to 1.5 mm in diameter and cut to lengths of about 1 to 2 mm.

* * * * *